US006085494A

United States Patent [19]

Lembke et al.

[11] Patent Number: 6,085,494

[45] Date of Patent: Jul. 11, 2000

[54] METHOD OF AND APPARATUS FOR WRAPPING ARTICLES OF THE TOBACCO PROCESSING INDUSTRY INTO BLANKS OF PACKING MATERIAL

[75] Inventors: Torsten Lembke, Duvensee; Wolfgang Schnabel, Oststeinbek, both of Germany

[73] Assignee: Topack Verpackungstechnik GmbH, Germany

[21] Appl. No.: 09/174,423

[22] Filed: Oct. 19, 1998

[30] Foreign Application Priority Data

Oct. 18, 1997 [DE] Germany ..... 197 46 141

[51] Int. Cl.[7] ..... B65B 11/00

[52] U.S. Cl. ..... 53/466; 53/231; 53/230; 53/228; 53/389.4; 53/234

[58] Field of Search ..... 53/466, 231, 230, 53/228, 220, 234, 389.4, 389.3, 389.2

[56] References Cited

U.S. PATENT DOCUMENTS

| | | | |
|---|---|---|---|
| 1,996,206 | 4/1935 | Jahne | 53/222 |
| 3,324,624 | 6/1967 | Mayer | 53/230 |
| 3,412,520 | 11/1968 | Schmermund | 53/230 |
| 4,095,394 | 6/1978 | Evrard | 53/220 |
| 4,430,842 | 2/1984 | Focke | 53/220 |
| 4,653,248 | 3/1987 | Bergner et al. | 53/231 |
| 4,711,065 | 12/1987 | Focke et al. | 53/234 |
| 4,924,653 | 5/1990 | Oly | 53/228 |
| 5,133,173 | 7/1992 | Draghetti et al. | 53/466 |
| 5,193,328 | 3/1993 | Boriani et al. | 53/466 |
| 5,216,870 | 6/1993 | Boriani et al. | 53/228 |
| 5,730,277 | 3/1998 | Meinke et al. | 198/468.6 |
| 5,732,533 | 3/1998 | Focke et al. | 53/234 |
| 5,845,464 | 12/1998 | Draghetti | 53/230 |
| 5,930,976 | 8/1999 | Boldrini et al. | 53/234 |

FOREIGN PATENT DOCUMENTS

| | | |
|---|---|---|
| 0794124A1 | 9/1997 | European Pat. Off. . |
| 19520849A1 | 12/1996 | Germany . |
| 19607419A1 | 9/1997 | Germany . |
| 847971 | 9/1960 | United Kingdom . |

*Primary Examiner*—Peter Vo
*Assistant Examiner*—Sam Tawfik
*Attorney, Agent, or Firm*—Venable; George H. Spencer; Robert Kinberg

[57] ABSTRACT

Cardboard blanks with fold lines between their panels are partially draped around arrays of cigarette packets in an apparatus wherein successive arrays which are being advanced along an elongated path at a first speed strip discrete blanks off a mouthpiece which is advanced along such path at a lesser second speed. Additional panels of a blank which is being transported by the mouthpiece, and a first panel of which is to be engaged and entrained by the front side of an oncoming array, are pivoted relative to the first panel along the respective fold lines by pivotable prefolding members which share the movement of and are caused to pivot relative to the mothpiece while the latter transports a blank at the second speed. The prefolding members cooperate with further folding members to pivot further panels of a blank relative to the additional panels while the blank is being transported by the mouthpiece.

31 Claims, 4 Drawing Sheets

METHOD OF AND APPARATUS FOR WRAPPING ARTICLES OF THE TOBACCO PROCESSING INDUSTRY INTO BLANKS OF PACKING MATERIAL

CROSS-REFERENCE TO RELATED CASES

This application claims the priority of German patent application Serial No. 197 46 141.7 filed Oct. 18, 1997. The disclosure of the German patent application, as well as that of each patent and of each published patent application mentioned in the specification of the present application, is incorporated herein by reference.

BACKGROUND OF THE INVENTION

The present invention relates to improvements in methods of and in apparatus for wrapping articles into prefabricated blanks, and more particularly to improvements in methods of and in apparatus for wrapping commodities of the tobacco processing industry (such as parallelepiped arrays or groups of cigarette packets wherein each of two superimposed layers contains five packets) into prefabricated multipanel blanks of cardboard, paper, plastic material or the like. Wrapped arrays of such character are popularly known as cartons. However, the method and the apparatus of the present invention can also serve to wrap other types of commodities, particularly block-shaped commodities such as groups of twenty plain or filter cigarettes, cigars or cigarillos each, into blanks of plastic material or cardboard to thus convert the blanks and the groups into packets, particularly those known as hinged-lid packets.

It is well known to confine groups of cigarettes (normally blocks of twenty parallel cigarettes with or without an inner wrapper of metallic foil or the like) or arrays of cigarette packets in prefabricated multipanel blanks of the type wherein neighboring panels are connected to each other by prefabricated fold lines in the form of elongated grooves, rows of slits, rows of perforations or the like. As a rule, the blanks carry printed and/or other (e.g., embossed) information and are made of cardboard, pasteboard, paper or a suitable plastic sheet material. A blank which is to be converted into the envelope of a carton containing ten cigarette packets normally comprises four elongated panels including two outer panels, an elongated flap attached to the free longitudinal edge of one of the outer panels, and relatively short flaps and tucks at the ends of certain panels other than the one outer panel. All panels are normally connected to the neighboring panels, flaps and tucks by elongated straight fold lines; this enhances the predictability and facility of folding the panels, flaps and tucks relative to each other and contributes to the appearance of the finished product, be it a packet, a carton or any other product wherein one or more commodities are confined in a box-shaped receptacle or container normally having four elongated sidewalls and two shorter end walls. The flaps and tucks are normally bonded to each other and/or to selected panels by a suitable adhesive which can be applied to portions of the surfaces of the blanks during conversion of such blanks into containers.

Presently known apparatus for making cartons, packets and like products of the tobacco processing industry (hereinafter referred to, for the sake of simplicity, as cartons for arrays of cigarette packets) normally comprise a pusher which propels an array of cigarette packets against a fixed blank extending across the path for the advancement and retraction of the pusher. The front side of the array is caused to strike against and to entrain a selected panel of the blank, e.g., through a passage defined by a tunnel, conduit, pipe or mouthpiece (hereinafter called mouthpiece) with attendant folding of additional panels of the entrained blank against additional sides of the advancing array. A drawback of such proposal is that, when the cartons are being produced at a high or very high frequency which is necessary to ensure that a modern production line for plain or filter cigarettes, cigars or cigarillos can process huge quantities of such rod-shaped articles per unit of time without necessitating the utilization of numerous carton forming and filling apparatus, impingement of the front side of an array against a selected panel of a stationary blank invariably causes the generation of pronounced noise. The noise becomes practically unbearable or necessitates a slowdown of the entire production line if the carton making and filling apparatus is installed in a building jointly with numerous additional apparatus. As a rule, a pusher is designed to advance successive arrays and the respective partially converted blanks into the pockets of an indexible turret or another suitable conveyor wherein the conversion of blanks into the containers of finished cartons is completed in a well known manner.

U.S. Pat. No. 5,133,173 (granted Jul. 18, 1992 to Draghetti et al. for "METHOD AND EQUIPMENT FOR WRAPPING GROUPS OF PACKETS") discloses a carton making apparatus wherein two (additional) panels of a stationary blank are pivoted (by means of a mouthpiece or a folding spindle) relative to a first panel between them before the first panel is engaged and entrained by the front side of an array consisting of two layers of five cigarette packets each. The array is caused to enter a stationary folding station wherein the prefolded blank is converted into the finished container of a carton. The noise which is generated on impact of the front side of an array of ten cigarette packets against the first panel of the preformed blank is compounded by noise which is generated by other mobile parts of the carton making and filling apparatus as well as by noise which is generated by other apparatus of a production line so that the overall noise level in a building housing numerous production lines is likely to become unbearable to the employees, especially for longer periods of time.

U.S. Pat. No. 4,653,248 (granted Mar. 31, 1987 to Bergner et al. for "APPARATUS FOR MAKING CARTONS OF CIGARETTE PACKS AND THE LIKE") discloses a carton making and filling apparatus wherein a pusher serves to propel each of a series of successive arrays of cigarette packets against a first panel of a discrete stationary blank which overlies the inlet of a mouthpiece. The blank is entrained through the mouthpiece with attendant folding of additional panels against the respective sides of the array while the latter advances through the mouthpiece and toward and into a deforming member which is thereupon caused to change its orientation through 90° to thus enable a pusher to propel the array and the partially converted blank into a receiving unit wherein the blank is caused to undergo additional conversion into a container of a finished carton. Such apparatus are also likely to generate pronounced noise when a production line employing the patented apparatus is caused to operate at a high or maximum capacity, because successive arrays are being propelled against stationary blanks.

German patent application Serial No. 196 07 419 A 1 (published Sep. 4, 1997 and owned by the assignee of the present application) discloses a carton making and filling apparatus wherein successive arrays of cigarette packets are propelled against stationary blanks with attendant generation of noise, especially if the apparatus is caused to operate at a maximum speed. The apparatus is provided with means for enhancing the appearance of the finished products by ensuring that selected panels of successive blanks are invariably caused to abut against the front sides of the respective arrays, starting with the acceleration of a blank from zero speed and ending with the completion of a forward stroke by a pusher for successive arrays.

OBJECTS OF THE INVENTION

An object of the invention is to provide a novel and improved method which renders it possible to turn out parallelepiped products, each consisting of a box-shaped commodity and a receptacle or container for the commodity, in a manner which entails the generation of acceptable or bearable noise without affecting the output of the apparatus which is utilized to practice the method.

Another object of the invention is to provide a method which renders it possible to prefold all or nearly all flaps, tucks and/or panels of a blank before the blank is contacted by the commodity which is to be confined in the converted blank.

A further object of the invention is to provide a method which renders it possible to treat preformed blanks gently preparatory to as well as during joint transport of blanks and of the commodities to be draped therein toward and through several blank deforming or converting stations.

An additional object of the invention is to provide a novel and improved method of converting discrete blanks into envelopes or containers which confine groups of rod-shaped or parallelepiped smokers' products in a manner such that each envelope of a short or long series of envelopes has a predictable optimum size and shape regardless of the selected rate of production of packets, cartons or the like.

Still another object of the invention is to provide a method which can be practiced by resorting to presently utilized blanks and customary commodities including arrays of rod-shaped articles or arrays of parallelepiped packets containing rod-shaped articles of the tobacco processing industry.

A further object of the invention is to provide a novel and improved apparatus for the practice of the above outlined method and to construct and assemble the apparatus in such a way that the level of noise which is generated when the apparatus is in use to make packets, cartons and like products is but a fraction of that generated by conventional carton making and analogous apparatus.

Another object of the invention is to provide the apparatus with novel and improved means for preforming or prefolding blanks preparatory to draping of such blanks around advancing arrays of rod-shaped articles, arrays of packets or the like.

An additional object of the invention is to provide the apparatus with novel and improved means for advancing and transporting blanks and parallelepiped commodities at speeds which are related to each other in a novel and improved way.

Still another object of the invention is to provide the apparatus with novel and improved means for making cartons for arrays of cigarette packets or the like.

A further object of the invention is to provide an apparatus of the above outlined character which can be put to use in existing production lines as a superior substitute for standard carton making and analogous apparatus.

Another object of the invention is to provide an apparatus which can turn out hinged-lid packets, cartons or analogous products of the tobacco processing industry at a speed matching or exceeding the speed or output of heretofore known apparatus but with the generation of less pronounced noise and without affecting the appearance and/or other desirable characteristics of the ultimate products.

An additional object of the invention is to provide novel and improved combinations of prefolding and other deforming means for blanks in a carton making apparatus or in an apparatus for making packets (such as hinged-lid packets) containing plain or filter-tipped rod-shaped articles of the tobacco processing industry.

Still another object of the invention is to provide an apparatus which is constructed and assembled in such a way that it can effectively reduce noise which is generated as a result of initial contact between a blank and a commodity to be draped in the converted blank as well as the noise which is generated as a result of folding of the blank prior to and/or following initial contact with a commodity.

A further object of the invention is to provide an apparatus which is designed to ensure that the time which is required for the making of discrete wrapped products (such as hinged-lid packets or cartons) is considerably shorter than those required by conventional apparatus.

Another object of the invention is to provide a novel and improved mechanism for transporting successive blanks of a series of blanks preparatory to initial contact of blanks with the commodities to be confined therein.

SUMMARY OF THE INVENTION

One feature of the invention resides in the provision of a method of wrapping commodities of the tobacco processing industry into deformable blanks, particularly a method of draping parallelepiped blocks of rod-shaped articles or arrays of packets containing rod-shaped articles in blanks of paper, cardboard, plastic material or the like. The improved method comprises the steps of advancing spaced-apart successive commodities of a series of commodities along a first path (e.g., along a straight horizonal path) in a predetermined direction and at a first speed, feeding successive blanks of a series of blanks along a second path into a predetermined portion of the first path so that each blank enters the predetermined portion of the first path in front of and spaced apart from an oncoming commodity advancing along the first path in the predetermined direction and toward the predetermined portion of the first path, and transporting successive blanks in the predetermined direction from the predetermined portion of and along the first path at least temporarily at a second speed less than the first speed so that the oncoming commodity catches up with and entrains the blank being transported along the first path.

The configuration of the commodities preferably resembles that of a block having a front side and at least three additional sides, and the step of feeding such commodities preferably includes locating blanks in the predetermned portion of the first path in such positions that a predetermined section or panel of a blank being transported beyond the predetermined portion of the first path confronts and is contacted by the front side of the oncoming commodity. Such method preferably further comprises the step of folding the blank which is being entrained by the respective oncoming commodity along at least two additional sides of such commodity.

The transporting step can include transporting the blanks at a second speed which is less than the first speed during each stage of transport of blanks along the first path to the very instant of entrainment of blanks (at the higher first speed) by the respective oncoming commodities. Otherwise stated, the transporting step can include uninterruptedly transporting blanks at the second speed during each stage of transport of the blanks along the first path from the predetermined portion of the first path until engagement of the predetermined sections or panels of such blanks by the front sides of the respective oncoming commodities. Expressed in still another way, the first speed can always exceed the second speed during transport of blanks from the predetermined portion of the first path until the blank being transported along the first path is engaged (caught up with or overtaken) by the respective oncoming commodity.

At least in many instances, the blanks which are being draped or wrapped in accordance with the improved method are provided with fold lines which separate the neighboring panels, flaps and tucks from each other and can be applied before the blanks are caused to enter the second path and/or during advancement of blanks along such second path. The method of draping or wrapping such blanks can further comprise the step of folding each blank along at least one of the fold lines while the blank dwells in the predetermined portion of the first path or during an initial stage of transport of the blank along the first path; such folding step during an initial stage of transport along the first path is or can be completed prior to entrainment of a blank by the respective oncoming commodity. Furthermore, such folding step can include folding each blank along a single fold line or (simultaneously or seriatim) along two or more fold lines.

If the folding step includes folding one or more portions of each blank subsequent to entrainment of such blank by the respective oncoming commodity, such folding can involve folding one or more portions of each blank around the respective (entraining) commodity, particularly directly (flush) against the adjacent side or sides of such commodity.

Folding of the blanks which are being entrained by the respective commodities can begin in the first path (i.e., while the blanks are being entrained by the respective commodities and are being transported at the second speed), and such folding of the blanks about the respective commodities can be completed downstream (i.e., outside) of the first path, for example, in the peripheral pockets of an indexible turret or in the pockets of an otherwise configurated and/or operated conveyor.

Another feature of the invention resides in the provision of an apparatus for draping commodities (such as arrays of rod-shaped articles or arrays of packets) into deformable blanks (e.g., blanks made of stiff paper, cardboard, pasteboard or plastic material). The apparatus comprises means for advancing spaced-apart successive commodities of a series of commodities along a first path in a predetermined direction and at a first speed, means for feeding successive blanks of a series of blanks along a second path into a predetermined portion of the first path so that each blank enters the predetermined portion of the first path in front of and spaced apart from an oncoming commodity advancing in the predetermined direction along and toward the predetermined portion of the first path, and means for transporting successive blanks from the predetermined portion of the first path, in the predetermined direction and at a second speed which is at least temporarily less than the first speed so that the oncoming commodity catches up with (i.e., overtakes) and entrains the blank being transported along the first path.

The commodities which are being advanced along the first path are preferably oriented in such a way that they have front sides facing in the predetermined direction during advancement of such commodities along the first path. The transporting means preferably includes means for maintaining the blanks being transported along the first path in an orientation such that the front side of an oncoming commodity which catches up with a blank in the first path comes into an at least substantially full contact with a predetermined section or panel of the respective blank. Since the commodities are normally parallelepipeds, they have a first side (such as the aforementioned front side) and more than two additional sides, and at least one of the advancing and transporting means preferably comprises means for folding blanks along at least two additional sides of the respective commodities while the blanks are being entrained by commodities along the first path. The apparatus is preferably designed in such a way that at least one of the advancing and transporting means comprises means for partially draping blanks around the respective commodities while the blanks are being entrained by commodities along the first path.

The transporting means can comprise a device (such as a reciprocable mouthpiece) which is movable with a blank from the predetermined portion of the first path in the predetermined direction and at the second speed and back toward the predetermined portion of the first path upon entrainment of a blank (which was being transported by such device) by the commodity advancing along and beyond the predetermined portion of the first path. The device is preferably mounted in such a way that it is movable back toward and all the way to the predetermined portion of the first path by moving along the first path. Such device preferably surrounds a part of the first path and is dimensioned in such a way that a blank and a commodity which is in the process of entraining the blank at the first speed can pass therethrough.

As already mentioned hereinbefore, the second speed can be less than the first speed during each stage of transport of a blank by the transporting means beyond the predetermined portion of and along the first path.

If the aforementioned device is a mouthpiece, the latter can define a passage which is sufficiently large for the advancement of successive commodities therethrough, and the transporting means of such apparatus can further comprise means (such as a suitable holder or carrier) for moving the mouthpiece in the predetermined direction from the predetermined portion of and along the first path through a predetermined distance which is sufficient to enable an oncoming commodity approaching at the first speed to catch up with the blank being transported by the mouthpiece at the second speed, and thereupon counter to the predetermined direction, along the first path and to a starting position at the predetermined portion of the first path.

As mentioned above, the means for moving the mouthpiece can comprise a reciprocable carrier, and such moving means preferably further comprises at least one guide extending along the first path and means for reciprocating the carrier along the at least one guide.

When the mouthpiece is located in its starting position, it is disposed behind a blank which occupies the predetermined portion of the first path. The advancing means for successive commodities can comprise a pusher which is reciprocable along the first path in and counter to the predetermined direction. Such apparatus can further comprise first motion transmitting means having means for recprocating the mouthpiece so that the movements of the mouthpiece in the predetermined direction take place at the second speed, second motion transmitting means having means for reciprocating the pusher so that the movements of the pusher in the predetermined direction take place at the first speed, and a common driving unit for the first and second motion transmitting means.

The blanks can be configurated and pretreated in such a way that each blank has a first panel or section abutting the front side of the respective commodity during entrainment of the blank along the first path, additional panels or sections flanking the first panel, and fold lines between the first panel and the additional panels. The means for transporting such blanks can comprise means for prefolding the additional panels relative to the first panel along the respective fold lines during transport of a blank from the predetermined portion of the first path and prior to entrainment of the blank by the respective oncoming commodity. The front portion of the aforementioned mouthpiece (which also forms part of the transporting means) can be provided with folding edges abutting the fold lines of a blank occupying the predetermined portion of the first path while the mouthpiece assumes its starting position and during movement of the mouthpiece from the starting position in the predetermined direction. Such transporting means can further comprise means for effecting a relative movement between the prefolding means and the mouthpiece during transport of blanks along the first path but prior to entrainment of the blanks by the respective oncoming commodities to thus effect a pivoting of the additional panels along the respective fold lines and counter to the predetermined direction as a result of the movement of the prefolding means and the mouthpiece relative to each other. Such transporting means preferably further comprises means for movably (such as pivotably) connecting the prefolding means with the mouthpiece.

The prefolding means can comprise two prefolding members each of which is adjacent a different one of the (preferably two elongated parallel) folding edges at the front portion of the mouthpiece. Each prefolding member is pivotable relative to the mouthpiece between a first position in which it is out of contact with an additional panel of the blank being transported by the folding edges of the mouthpiece and a second position in which the prefolding member maintains the adjacent additional panel in a pivoted position relative to the respective first panel.

The means for pivotably coupling the prefolding members to the mouthpiece (either directly or indirectly, e.g., by way of the aforementioned carrier) is preferably designed to enable the mouthpiece to move with the prefolding members in and counter to the predetermined direction as well as to enable the prefolding members to pivot relative to the mouthpiece so that such prefolding members move at least in part beyond the adjacent folding edges of the mouthpiece as seen counter to the predetermined direction. Each prefolding member can be dimensioned to lie flush or practically flush against an entire additional panel of a blank having fold lines abutting the folding edges at the front end of the mouthpiece.

The prefolding members can be provided with rectangular and/or otherwise configurated windows.

The blanks can be of the type having further panels and further fold lines between the aforementioned additional and the just mentioned further panels. The prefolding members can include further folding edges (i.e., folding edges other than those provided at the front end of the mouthpiece) arranged to engage the further fold lines of a blank being transported by the mouthpiece along the first path. The transporting means of such apparatus can comprise further folding members which cooperate with the prefolding members to pivot the further panels relative to the respective additional panels during pivoting of the prefolding members relative to the mouthpiece.

The further folding edges are or can be parallel to the folding edges at the front end of the mouthpiece. The further folding panels can have arcuate shapes and are preferably installed adjacent to the paths of pivotal movement of the prefolding members relative to the mouthpiece.

The advancing means (e.g., the aforementioned pusher of the advancing means) can advance successive commodities and the corresponding blanks beyond the discharge end of the first path, e.g., into successive radially inwardly extending peripheral pockets or receptacles of an indexible turret wherein the conversion of blanks into receptacles for the respective commodities is completed or at least further advanced. For example, the turret can carry and/or can move the partially deformed blanks past deforming members which are designed to provide the receptacles with end walls.

The novel features which are considered as characteristic of the invention are set forth in particular in the appended claims. The improved apparatus itself, however, both as to its construction and the methods of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
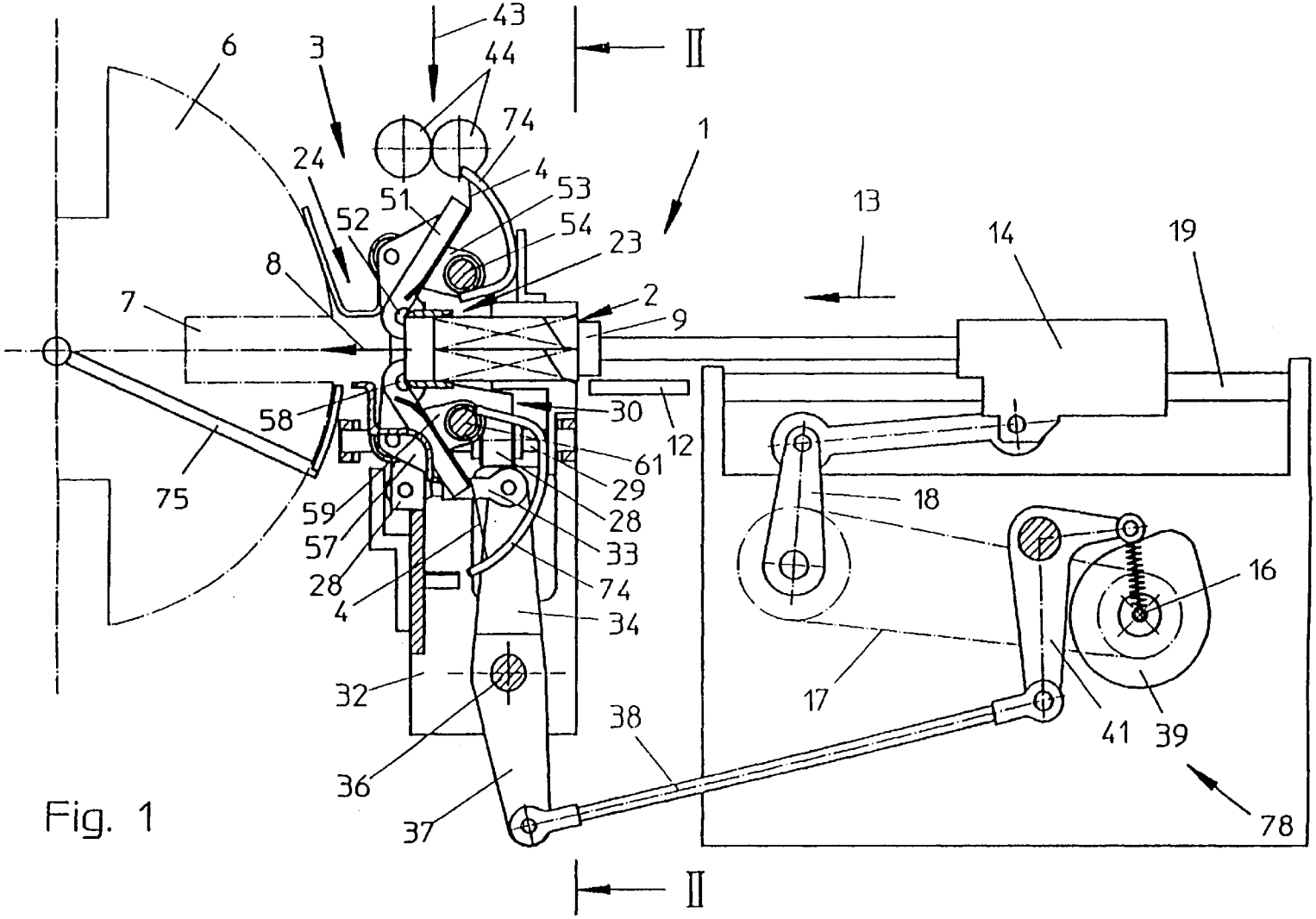
FIG. 1 is a somewhat schematic partly elevational and partly vertical sectional view of an apparatus which embodies one form of the inventon, a blank being shown in the process of being predeformed in the predetermined portion of the first path and an array of ten cigarette packets being advanced toward engagement of its front side with a selected panel of the blank.
Figure 2:
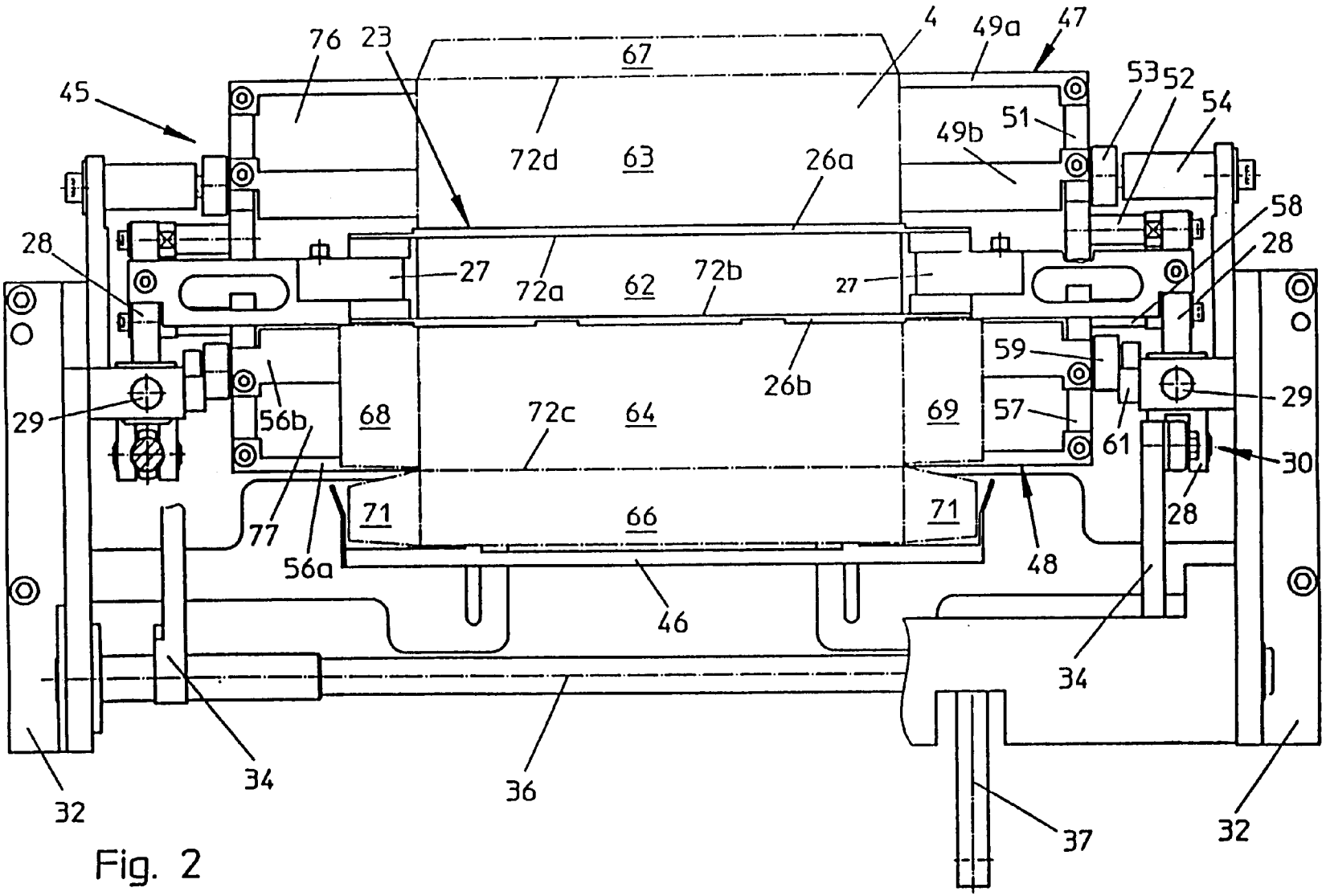
FIG. 2 is an enlarged view substantially as seen in the direction of arrows from the line II—II of FIG. 1 and shows that side of a panel in the predetermined portion of the first path which is about to be engaged by the front side of the oncoming array of packets.
Figure 3:
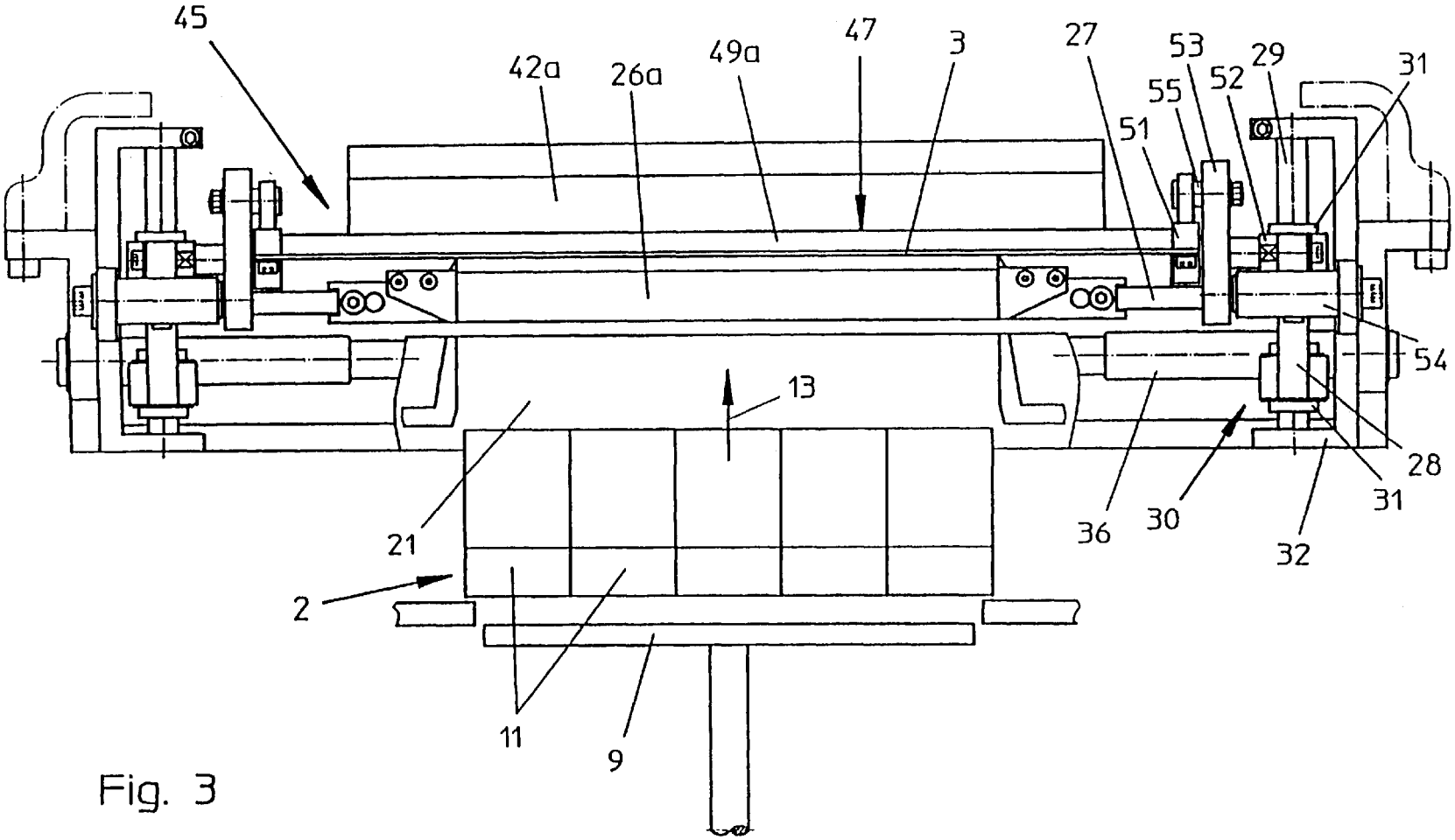
FIG. 3 is an enlarged plan view of a portion of the apparatus which is shown in FIG. 1 and illustrates the mouthpiece of the blank transporting and predeforming means in its starting position; and PIG. 4 is an enlarged view of a detail in the apparatus of FIG. 1 but with an undeformed blank shown in the predetermined portion of the first path.
Figure 4:
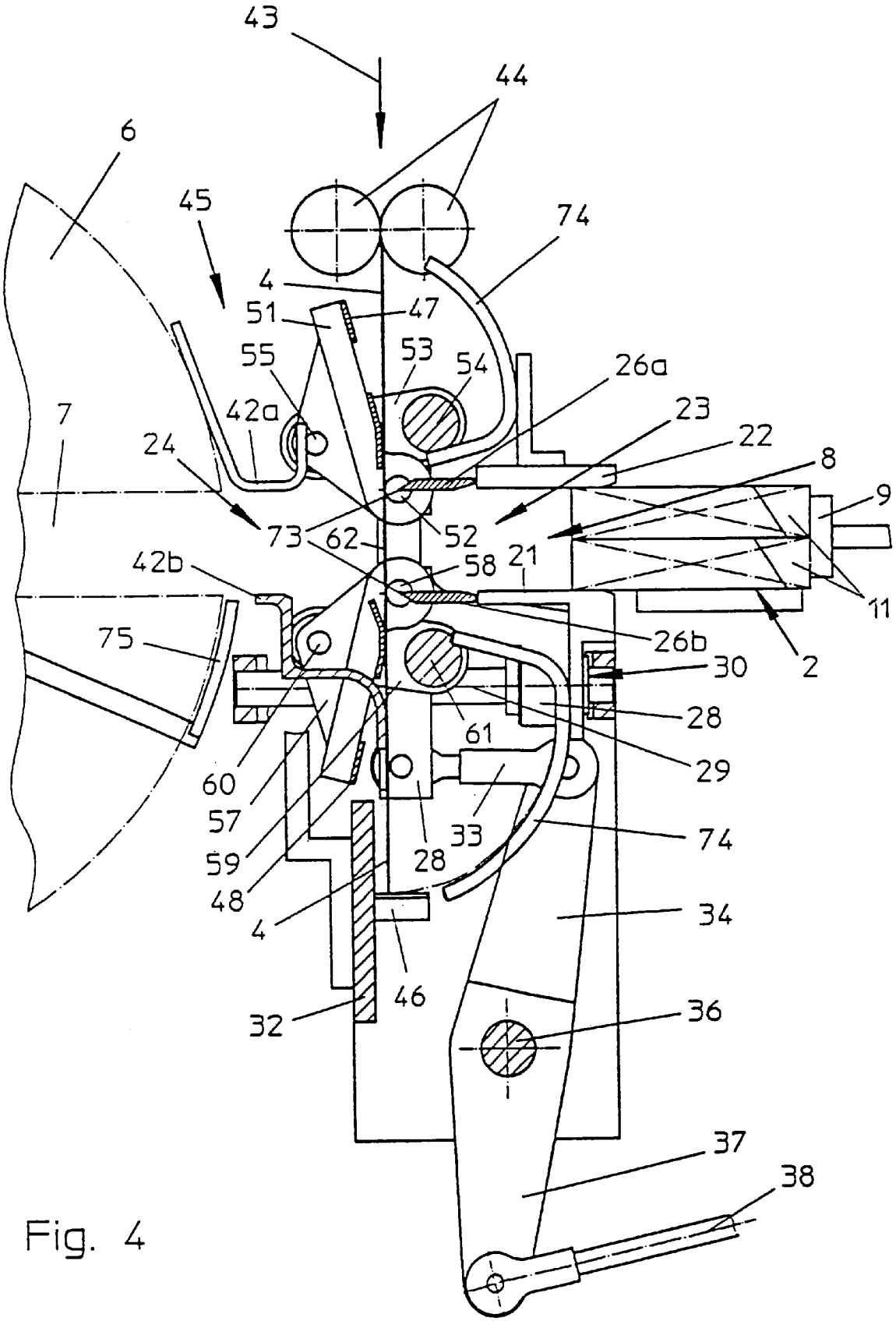

FIGS. 1 to 3 illustrate the relevant component parts of a wrapping or draping apparatus for elongated block-shaped commodities 2 each of which consists of an array of ten cigarette packets or boxes 11 (e.g., so-called hinged-lid or flip-top boxes or packets) which form two superimposed layers or rows of five packets each. One full layer of five packets 11 can be seen in FIG. 3, and each of FIGS. 1 and 4 shows a stack of two superimposed packets 11 at one end of an array of ten packets.

The means for advancing successive commodities or arrays 2 (hereinafter called arrays for short) along a straight elongated horizontal path (denoted by the arrow 8 shown in each of FIGS. 1 and 4) in a direction to the left, as viewed in FIGS. 1 and 4 and as indicated by an arrow 13, comprises a reciprocable pusher 9 at the front end of an elongated rod extending from a slide or carriage 14 which is reciprocable along one or more horizontal guides 19 by a mechanism including a crank drive receiving motion from a driving unit 78 and coupled to the carriage 14 by a link (shown but not referenced in FIG. 1).

The means for supplying a succession of arrays 2 to a transfer station 1 where the arrays enter the path 8 comprises a conveyor 12 (e.g., an endless belt or chain conveyor) which receives packets 11 from a cigarette packing machine, not shown (e.g., a packing machine known as COMPAS 500 which is distributed by the assignee of the present application). Partly finished cartons (each comprising an array 2 and a blank 4 partially draped around such array) are advanced along and beyond the path 8 and into successive radially inwardly extending peripheral receptacles or pockets 7 of a conveyor 6 here shown as a turret which is indexible about a horizontal axis extending transversely of the path 8.

The driving unit 78 comprises a prime mover (e.g., a variable-speed motor having an output shaft 16 carrying a sprocket wheel or a pulley which drives an endless chain or belt 17 for the rotary input element of the aforementioned crank drive 18.

The path 8 is defined in part by a horizontal supporting surface of a bottom wall 21, and in part by a top wall 22 cooperating with the bottom wall 21 to guide a succession of spaced-apart arrays 2 along the path 8 when the advancing means including the carriage 14 causes the pusher 9 to perform successive forward strokes in the direction of arrow 13 and to thus advance arrays 2 toward, through and beyond a device 23 forming part of a means for transporting a succession of discrete blanks 4 from a predetermined portion 3 of the path 8 into the registering pockets 7 of the indexible turret 6.

As can be seen in FIGS. 1, 2 and 4, the device 23 is an elongated mouthpiece which extends transversely of the path 8 and defines a wide passage for successive arrays 2 which are about to entrain discrete blanks 4 on their way toward the turret 6. A stationary second mouthpiece 24 is located downstream of and registers with the mobile mouthpiece 23 of the blank transporting means. The mouthpiece 24 can be said to form part of or to constitute a means for guiding successive arrays 2 (and the respective partly deformed blanks 4) on their way beyond the mouthpiece 23 and beyond the outlet or discharge end of the path 8 into successive pockets 7.

The means for feeding successive plate-like blanks 4 from a source (e.g., a magazine, not shown) along a second path (indicated by an arrow 43) into the predetermined portion 3 of the (first) path 8 comprises intermittently or continuously driven rollers 44. A freshly delivered blank 4 assumes a required position in the predetermined portion 3 of the path 8 when its lower edge rests on a stationary supporting platform 46 affixed to a frame 32 of the improved apparatus. The blank 4 is then located in a vertical plane in front of the mouthpiece 23 which occupies a starting or rearmost position shown in FIG. 4, namely immediately in front of the top wall 22. The mouthpiece 23 forms part of a transporting system or unit 30 which serves to transport successive blanks 4 of a series of blanks from the predetermined portion 3 of the first path 8 and in the direction of the arrow 13 at a (second) speed at least temporarily less than the (first) speed of the pusher 9 when the latter is in the process of carrying out a forward stroke toward, across and beyond the predetermined portion 3 of the first path 8. This enables an array 2 which is being advanced by the pusher 9 to catch up with (i.e., to overtake) the blank 4 which is being pushed by two parallel horizontal folding edges 73 at the front end of the mouthpiece 23 at the second speed at least temporarily less than the (first) speed of the pusher 9.

The mouthpiece 23 comprises a top wall 26*a* and a bottom wall 26*b*. These walls can be said to constitute or to form part of a mens for partially draping blanks 4 around the respective arrays 2, and the foremost part of each of the walls 26*a*, 26*b* defines one of the aforementioned folding edges 73. The walls 26*a*, 26*b* extend transversely of the path 8 and their ends are affixed to holders 27 (see FIGS. 2 and 3) which can be said to constitute the lateral end walls of the mouthpiece 23 and are located at opposite sides of the path 8. The end walls 26*a*, 26*b* and the holders 27 surround a part of the first path 8, and the carriage which is defined by such constituents of the mouthpiece 23 is dimensioned to permit successive arrays 2 to advance through the space between the wals 26*a*, 26*b* toward, and to ultimately lie flush or substantially flush against, selected panels or sections 62 (see FIGS. 2 and 4) of the blanks 4 being engaged and transported by the folding edges 73 of the walls 26*a*, 26*b*.

The holders 27 are mounted on discrete carriers 28 which receive motion from the driving unit 78 and serve to move the mouthpiece 23 along the first path back and forth, namely forwardly (arrow 13) from the starting position of FIG. 4 behind the portion 3 of the first path 8, through a predetermined distance, and thereupon along the path 8 but in the opposite direction and back to the starting position shown in FIG. 4. The aforementioned predetermined distance is a function of the difference between the first and second speeds and is sufficient to ensure that an oncoming array 2 (which is being advanced by the pusher 9 at the first speed) can catch up with the (by then partly deformed) blank 4 having two parallel fold lines 72*a*, 72*b* then engaged by the folding edges 73 of the mouthpiece 23 which transports the blank 4 at the second speed (i.e., at a speed which is at least temporarily less than the first speed).

The holders 27, the carriers 28 and the walls 26*a*, 26*b* of the mouthpiece 23 together constitute a slide or carriage of the means 30 for transporting successive blanks 4 from the predetermined portion 3 of the first path 8. A transporting step is completed when an oncoming array 2 catches up with and strips the blank 4 off the folding edges 73 of the walls 26*a*, 26*b*. The carriers 28 are reciprocable along guides 29 which are parallel to the adjacent portion of the first path 8. Each carrier 28 is provided with a bearing sleeve 31 which slidably surrounds a portion of the respective guide 29. These guides are mounted in the stationary frame 32.

Since the two halves of the illustrated apparatus are or can be mirror images of each other (with reference to a vertical plane which halves the blank 4 shown in FIG. 2), a large majority of reference characters denoting the parts shown in FIGS. 2 and 3 are applied only in the right-hand portions of these Figures.

The means for transmitting motion from the driving unit 78 of FIG. 1 to the carriage including the carriers 28 of the transporting system 30 comprises a cam 39 which is driven by the shaft 16, a bell crank lever 41 having a roller follower which tracks the periphery of the cam 39, a link 38 which transmits motion from the bell crank lever 41 to a lever 37 serving to rock a horizontal pivot member 36 extending transversely of and located beneath the first path 8, and links 33 which couple levers 34 on the pivot member 36 with the carriers 28. The end portions of the pivot members 36 are rockably mounted in the respective portions of the frame 32.

An advantage of the driving unit 78 and of the two motion transmitting means respectively connecting the shaft 16 (a)

with the carriage 14 for the pusher 9 and (b) with the carriage including the carriers 28 is that the forward movements (arrow 13) of the pusher 9 are properly synchronized with forward movements of the mouthpiece 23 so that the locus of impingement of front sides of successive arrays 2 upon the panels 62 of the partially deformed blanks 4 in front of them is always disposed at the same distance from the predetermined portion 3 of the first path 8.

The stationary second mouthpiece 24 comprises an upper guide track 42*a* and a lower guide track 42*b* (see FIG. 4); these tracks are respectively located above and below the outlet of the first path 8. The second path (denoted by the arrow 43) is located between the stationary mouthpiece 24 and the mobile (reciprocable) mouthpiece 23 when the latter assumes the starting position (i.e., the fully retracted position) of FIG. 4. The platform 46 for the (still undeformed) blank 4 which occupies the predetermined portion 3 of the first path 8 extends transversely of such path and has end portions affixed to the adjacent portions of the frame 32 (see FIG. 2).

The carriers 28 of the transporting system 30 for successive blanks 4 further serve to support a prefolding unit 45 including two plate-like prefolding members 47, 48 for additional panels 63, 64 flanking the first panel 62 of he blank 4 in the first path 8. The upper prefolding member 47 comprises two spaced-apart elongated portions 49*a*, 49*b* (see FIG. 2) which are attached to pivotable arms 51 flanking the path 8. The arms 51 are pivotable about the axis of a two-piece horizontal shaft 52 which is mounted in the carriers 28 for the mobile mouthpiece 23.

The arms 51 are further connected to a stationary horizontal shaft 54 by means of links 53 and fulcra 55. The axis of the shaft 52 coincides with the folding edge 73 at the front end of the top wall 26*a* of the mobile mouthpiece 23. The feature that the prefolding member 47 is pivotably mounted (by means of the arms 51) on the mouthpiece 23 and is further articulately connected (at 52, 53) with the stationary shaft 54 renders it possible to pivot the prefolding member 47 in a clockwise direction (as viewed in FIGS. 1 and 4) to a position in which at least a portion (49*a*) of the member 47 is located behind the nearer folding edge 73 (as considered in the direction which is indicated by the arrow 13). FIG. 4 shows the panel or section 63 of the blank 4 in the path portion 3 prior to partial folding along the fold line 72*a* between the panels 62, 63 of such blank, and FIG. 1 shows the panel 63 during prefolding or partial folding. Such folding of the panel 63 takes place while the mouthpiece 23 and the blank 4 are being transported along the first path 8 in the direction of arrow 13 but prior to entrainment of the panel 62 of the blank 4 by the front side of of the oncoming commodity or array 2. The pivoting of the prefolding member 47 (i.e., of the portions 49*a*, 49*b*) takes place about the axis of the shaft 52

The prefolding of the panel 63 by the member 47 in a clockwise direction continues beyond the intermediate position of FIG. 1, and the direction of pivotal movement of the prefolding member 47 (without the panel 63) is thereupon reversed, i.e., the member 47 is returned to the idle position of FIG. 4.

The lower prefolding member 48 is or can be a mirror image of the upper prefolding member 47. The member 48 comprises two spaced-apart elongated prefolding portions 56*a*, 56*b* which are mounted on the carriers 28 at a level beneath the (first) path 8 for pivotal movement about an axis (defined by a shaft 58) which coincides with the lower folding edge 73 (at the front end of the lower wall 26*b* of the reciprocable mouthpiece 23). The connection between the lower prefolding member 48 and the shaft 58 comprises arms 57 corresponding to the arms 51 for the upper prefolding member 47. The prefolding member 48 is further coupled to a stationary horizontal shaft 61 (corresponding to the shaft 54) by links 59 (corresponding to the links 53) so that the member 48 can pivot (counterclockwise, as viewed in FIG. 4) from the idle position of FIG. 4, through the intermediate position of FIG. 1, to an end position, and thereupon (clockwise, as viewed in FIG. 1) back to the idle position of FIG. 4. During such pivoting from the position of FIG. 4, at least a portion (56*a*) of the prefolding member 48 is caused to assume a series of positions behind the lower folding edge 73 (at the front end of the wall 26*b*) as seen in the direction indicated by the arrow 13). The exact details of the presently preferred mode of pivotally mounting the prefolding members 47, 48 for reciprocatory movements with as well as for pivotal movements relative to the mouthpiece 23 are shown in FIGS. 2 and 3. The lower prefolding member 48 serves to prefold an additional panel or section 64 of a blank 4 which is being transported by the mouthpiece 23 along the path 8; at such time, the folding edges 73 of the walls 26*a*, 26*b* bear upon the fold lines 72*a*, 72*b* between the front panel or section 62 on the one hand, and the additional panels or sections 63, 64 on the other hand, the prefolding member 47 pivots the additional panel 63 and a further panel or section 67 relative to the first panel 62, and the prefolding member 48 pivots the additional panel 64 and a further panel or section 66 relative to the first panel 62.

The further panel 67 is actually an elongated flap which is connected with the additional panel 63 along a fold line 72*d* parallel to the fold lines 72*a*, 72*b*. The further panel 66 is connected with the additional panel 64 along a fold line 72*c* which is parallel to the fold lines 72*a*, 72*b* and 72*d*. The end portions of the additional panel 64 are connected with flaps 68, 69 which constitute the end walls of the receptacle (fully converted blank 4) of a finished carton, and the end portions of the further panel 66 (and/or one of the panels 62, 63) carry tucks 71 which are connected to the flaps 68, 69 (when the conversion of the blank 4 of FIG. 2 into a receptacle is completed). The flaps and the tucks are connected with the respective panels by straight fold lines which are shown (but not referenced) in FIG. 2.

FIG. 4 shows that, when the members 47, 48 of the prefolding unit 45 are caused to assume their fully retracted (idle) positions, their portions 49*a*, 49*b* and 56*a*, 56*b* do not interfere with the feeding of a fresh (undeformed) blank 4 into the predetermined portion 3 of the first path 8. As already mentioned before, a properly positioned or located blank 4 rests on the supporting platform 46 which (as shown in FIG. 2) can be provided with upwardly extending outwardly flaring ramps to ensure that the freshly supplied blank assumes a required position as seen transversely of the path 8. The fold lines (including those numbered 72*a* to 72*d*) are sufficiently pronounced to ensure predictable folding of the panels 62–64 and 66–67, of the flaps 68, 69 and tucks 71 relative to each other.

The length of a properly assembled array 2 of ten packets 11 matches or is only slightly less than the length of a panel 62, 63, 64, 66 or 67. The front side of such array 2 (namely the upper side, as viewed in FIG. 3) comes into preferably full face-to-face abutment with the first panel 62 of a partly converted blank 4 which is being transported by the front edges of the walls 26*a*, 26*b* forming part of the reciprocable mouthpiece 23. The front edges 73 abut the adjacent fold lines 72*a*, 72*b* between the first panel 62 and the adjacent additional panels 63, 64 when the blank 4 resting on the supporting platform 46 is set in motion along the first path 8 as a result of forward movement of the mouthpiece 23 (in the direction indicated by the arrow 13).

The operation of the improved apparatus is as follows:

At the start of a cycle (which involves partial draping of an array 2 into a blank 4 and the transport of the thus partly deformed blank and the corresponding array into the registering empty pocket 7 at the discharge end or outlet of the first path 8), the mouthpiece 23 is held in the starting or retracted position of FIG. 4, i.e., upstream of the (second) path denoted by the arrow 43, and the members 47, 48 of the prefolding unit 45 are located at the other side of the second path. This clears the discharge end of the second path (i.e., the predetermined portion 3 of the first path 8) for the admission of a fresh blank 4 which comes to rest (at the desired level and also as considered transversely of the path 8) on the supporting platform 46. The first panel 62 of such blank 4 is located between the two folding edges 73 which abut or are immediately adjacent the fold lines 72*a*, 72*b*. The pusher 9 abuts the rear side of the array 2 (which was delivered by the conveyor 12) and is in the process of advancing such array toward the inlet of the passage defined by the walls 26*a*, 26*b* of the mobile mouthpiece 23 (see FIG. 4).

The cam 39 can cause the arms 34 of the means for transmitting motion to the mouthpiece 23 (in the direction of the arrow 13 and counter to such direction) as soon as or with a certain delay after the shaft 16 of the driving unit 78 causes the pusher 9 to proceed with the advancement of the array 2 along the first path 8 and toward the mouthpiece 23. The folding edges 73 of the mouthpiece 23 entrain the blank 4 from the path portion 3 by bearing upon the adjacent fold lines 72*a*, 72*b*, and such transport of the blank 4 along the first path 8 begins before the front side of the array 2 being advanced by the pusher 9 comes into actual contact with the rear side of the panel 62 between the folding edges 73.

The prefolding members 47, 48 begin to pivot relative to the mouthpiece 23 as soon as or shortly after this mouthpiece is set in motion toward the turret 6, and such pivoting of the members 47, 48 brings about a pivoting of the additional panels 63, 64 along the respective fold lines 72*a*, 72*b*. Pivoting of the panels 63, 64 relative to the first panel 62 can involve full face-to-face contact of the portions 49*a*, 49*b* and 56*a*, 56*b* with the adjacent additional panels. FIG. 1 shows the additional panels 63, 64 in partially folded or pivoted positions, i.e, such panels are outwardly adjacent to but not in actual contact with the exposed sides of the respective walls 26*a*, 26*b* of the advancing mouthpiece 23.

FIG. 2 shows that the prefolding members 47, 48 are provided with relatively large cutouts or windows 76, 77 to thus greatly reduce the areas of impact of these prefolding members against the respective additional panels 63, 64. This has been found to contribute to a reduction of noise which is being generated as a result of abrupt impact of the portions 49*a*, 49*b* and 56*a*, 56*b* against the front sides of the respective panels 63, 64 of the blank 4 being pushed by the folding edges 73. The windows 76, 77 can extend all the way across the first path 8 so that the additional panels 63, 64 are engaged only by the relatively narrow elongated portions 49*a*, 49*b* and 56*a*, 56*b* of the respective prefolding members 47, 48. It has been found that such design of the prefolding members 47, 48 does not affect the quality of their prefolding action, i.e., the accuracy of pivoting the additional panels 63, 64 along the respective fold lines 72*a*, 72*b*.

In accordance with a further desirable and advantageous feature of the invention, the improved apparatus further comprises means for automatically pivoting the further panels 66, 67 along the respective further fold lines 72*c*, 72*d* and relative to the adjacent additional panels 63, 64 in response to pivoting of the prefolding members 47, 48 from the positions of FIG. 4 toward and beyond the positions shown in FIG. 1. This is accomplished by the provision of preferably arcuate further folding members 74 which share the movements of the mouthpiece 23 and have concave surfaces confronting the respective prefolding members 47, 48. The outer edges of the portions 49*a*, 56*a* of the prefolding members 47, 48 constitute further folding edges which abut the fold lines 72*d*, 72*c* during pivoting of the members 47, 48 from the idle positions of FIG. 4. This causes the further panels 67, 66 to pivot relative to the adjacent additional panels 63, 64 along the respective fold lines 72*d*, 72*c* because the free edges of the panels 67, 66 slide along and are pivoted by the concave surfaces of the respective further folding members 74.

It will be seen that the additional panels 63, 64 are pivoted relative to the first panel 62, and that the further panels 67, 66 are simultaneously pivoted relative to the respective additional panels 63, 64 as a result of pivoting of the prefolding members 47, 48 of the unit 45 with reference to the mouthpiece 23 while the latter transports a blank 4 along the first path 8 in the direction indicated by the arrow 13. In other words, pivoting of the panels 63, 64, 66, 67 relative to the panel 62 and relative to each other takes place and can be completed even before the panel 62 is engaged and entrained beyond the mouthpiece 23 by the oncoming array 2 of ten properly assembled packets 11. Such prefolding along all four fold lines 72*a*–72*d* has been found to be highly desirable and advantageous because it ensures predictable conversion of each blank 4 of a short or long series of successive blanks into a receptacle having an optimum size and shape for snugly receiving the respective array 2. Furthermore, such prefolding of all fold lines between the panels 62–64 and 66–67 contributes to the appearance of the ultimate products (cartons) and reduces the number of rejects.

The speed of forward movement of the mouthpiece 23 along the first path 8 is selected in such a way that the blank 4 which is being transported by the front edges 73 is overtaken by the front side of the array 2 being advanced by the pusher 9 toward, into and beyond the passage defined by the mouthpiece 23. In other words, the (second) speed of the mouthpiece 23 is less (at least temporarily) than the (first) speed of the array 2 which is being advanced by the pusher 9 so that the preformed (i.e., partially converted) blank is stripped off the mouthpiece 23 and is advanced relative to such mouthpiece toward and into that empty pocket 7 of the turret 6 which is maintained in a position of register with the outlet of the first path 8. The mouthpiece 23 can begin its return stroke (along the path 8 but counter to the direction indicated by the arrow 13) as soon as the blank 4 is stripped off its folding edges 73. The prefolding members 47, 48 are also pivoted back to their starting positions of FIG. 4 not later than when the mouthpiece 23 reassumes its starting position.

An important advantage of the feature that the mouthpiece 23 is in motion in the same direction (arrow 13) as the array 2 when the latter strikes against the first panel 62 and strips the blank 4 off the folding edges 73 is that the impact of the array 2 against the first panel 62 is much less pronounced than if the array were to impact against a stationary blank. This results in a highly pronounced and readily detectable reduction of noise generation.

The additional panels 63, 64 are folded against the respective sides (namely the upper side and the underside) of the array 2 during advancement with such array through the stationary second mouthpiece 24 and into the registering pocket 7 of the conveyor 6. The originally flat blank 4 is converted into a U-shaped body during advancement through the second mouthpiece 24, and such conversion is facilitated and rendered more predictable due to the prefolding of the additional panels 63, 64 by the portions 49*a*, 49*b* and 56*a*, 56*b* of the respective prefolding members 47, 48.

The conveyor 6 cooperates with a stationary or pivotable folding member 75 which completes or renews the pivoting of the panel 66 along the folding edge 72*c* so that the panel 66 overlies the rear side of the array 2 in its pocket 7. The folding member 75 can pivot the panel 66 as soon as the pusher 9 is at least slightly retracted by the carriage 14, i.e., as soon as there is sufficient room between the array 2 in its pocket 7 and the pusher 9. It is assumed here that the pivoting of the panel 66 takes place as a result of counterclockwise pivoting of the folding: member 75 relative to the conveyor 6 (as viewed in FIG. 1 or 4).

The exact relationship between the first and second speeds is determined by the design or appropriate adjustment of the driving unit 78, of the motion transmitting connection between the shaft 16 of the driving unit 78 and the carriage 14 for the pusher 9, and of the motion transmitting means between the shaft 16 and the mouthpiece 23. As already mentioned above, the motion transmitting means between the shaft 16 and the mouthpiece 23 can further serve to effect a pivoting of the prefolding members 47, 48, i.e., a desirable prefolding of all five panels 62–64 and 66–67 relative to each other.

It will be appreciated that the improved apparatus is susceptible of numerous additional modifications without departing from the spirit of the instant invention. For example, it is possible to provide discrete driving units for the pusher 9 and for the mouthpiece 23, and to make at least one of the two driving units adjustable to permit changes of the first and/or second speed for the purpose of regulating the noise level without necessarily reducing the output of the apparatus.

Furthermore, the improved method and apparatus can be modified to an extent which is necessary to confine arrays of parallel rod-shaped articles in blanks to make packets, e.g., the so-called hinged-lid or flip-top boxes or packets.

Still further, the ratio of the first and second speeds can be adjusted in order to account for the desired output of the apparatus (e.g., the number of cartons to be turned out per unit of time) and/or for the material of the blanks.

The prefolding members 47, 48 (or equivalent prefolding members) can be mounted on the mobile mouthpiece 23 or on a constituent of the means for reciprocating this mouthpiece or its equivalent along the first path 8.

The exact manner of completing the conversion of blanks 4 or analogous blanks of stiff paper, cardboard or other suitable material into the receptacles of cartons, hinged-lid packets or the like forms no part of the present invention. Thus, the flaps 68, 69 and the tucks 71 can be folded and connected to each other or to selected panels in the same way as is known from the art of conventional apparatus. Reference may be had to the so-called B-90 cigarette pack boxer which is distributed by the assignee of the present application.

The sizes of the panels, the sizes and/or the numbers and/or the shapes of the flaps, and/or the sizes and/or the numbers and/or the shapes of the tucks can vary, depending upon the dimensions of the packets 11 and/or the preferences of the manufacturers. Such alterations have no bearing on the method and/or on the apparatus of the present invention since the invention is primarily concerned with the reduction of noise and with prefolding of at least some of the panels rather than with the exact dimensions of the packets 11, arrays 2, blanks 4, panels and/or flaps and/or tucks, and/or with the exact number and/or configuration of the constituents of the blanks.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of methods of and apparatus for wrapping articles of the tobacco processing industry into blanks of packing material and, therefore, such adaptations should and are intended to be comprehended within the meaning and range of equivalence of the appended claims.

What is claimed is:

1. A method of draping commodities of the tobacco processing industry into deformable blanks, comprising the steps of:

advancing spaced-apart successive commodities of a series of commodities along a first path in a predetermined direction and at a first speed;

feeding successive blanks of a series of deformable blanks along a second path into a predetermined portion of the first path so that each blank enters the predetermined portion of the first path in front of and spaced apart from an oncoming commodity advancing along the first path in said direction and toward said predetermined portion of said first path; and transporting successive blanks in said direction from said predetermined portion of and along the first path at least temporarily at a second speed less than the first speed so that the oncoming commodity catches up with and entrains that blank of said successive blanks which is being transported along the first path with attendant acceleration of the blanks in said first path from said second speed to said first speed.

2. The method of claim 1 of draping commodities having a front side and at least three additional sides, wherein said feeding step includes locating blanks in said predetermined portion of the first path in positions such that a predetermined section of a blank being transported along said first path confronts and is contacted by the front side of the oncoming commodity, and further comprising the step of folding the blank which is being entrained by the respective oncoming commodity along at least two additional sides of such commodity.

3. The method of claim 1, wherein said transporting step includes transporting the blanks at a second speed which is less than the first speed during each stage of transport of blanks along said first path to the instant of entrainment by oncoming commodities.

4. The method of claim 1 of draping commodities having front sides into blanks having predetermined sections arranged to be engaged and entrained by the front sides of the respective oncoming commodities, wherein said transporting step includes uninterruptedly transporting blanks at said second speed during each stage of transport of blanks along the first path from said predetermined portion of the first path until engagement of the predetermined sections by the front sides of the respective oncoming commodities.

5. The method of claim 1, wherein the first speed always exceeds the second speed during transport of blanks from said predetermined portion of the first path until the blank is engaged by the respective oncoming commodity.

6. The method of claim 1 of draping commodities into blanks having fold lines not later than upon completion of the feeding step, further comprising the step of folding each blank along at least one of the fold lines during an initial stage of transport along the first path.

7. The method of claim 6, wherein said folding step is completed prior to entrainment of a blank by the respective oncoming commodity.

8. The method of claim 6, wherein said folding step includes folding each blank along a plurality of fold lines.

9. The method of claim 1, further comprising the step of folding successive blanks around the respective commodities during entrainment of the blanks by the respective commodities.

10. The method of claim 1, further comprising the steps of folding the entrained blanks about portions of the respective commodities in the first path, and completing the folding of blanks about the respective commodities downstream of the first path.

11. Apparatus for draping commodities of the tobacco processing industry into deformable blanks, comprising:

means for advancing spaced-apart successive commodities of a series of commodities along a first path in a predetermined direction and at a first speed;

means for feeding successive blanks of a series of deformable blanks along a second path into a predetermined portion of said first path so that each blank enters said predetermined portion of said first path in front of and spaced apart from an oncoming commodity advancing in said direction along and toward said predetermined portion of said first path; and means for transporting successive blanks from said predetermined portion of said firs path, in said predetermined direction and at a second speed at least temporarily less than said first speed so that the oncoming commodity catches up with and entrains that blank of said successive blanks which is being transported along said first path with attendant acceleration of the blank in said first path from said second speed to said first speed.

12. The apparatus of claim 11, wherein the commodities have front sides facing in said direction during advancement of commodities along said first path, said transporting means including means for maintaining the blanks being transported along said first path in an orientation such that the front side of an oncoming commodity which catches up with a blank in said first path comes into an at least substantially full contact with a predetermined section of the respective blank.

13. The apparatus of claim 12, wherein said commodities have at least three additional sides and further comprising means for folding blanks along at least two additional sides of the respective commodities while the blanks are being entrained by commodities along said first path.

14. The apparatus of claim 11, further comprising means for partially draping blanks around the respective commodities while the blanks are being entrained by commodities along said first path.

15. The apparatus of claim 11, wherein said transporting means comprises a device which is movable with a blank from said predetermined portion of said first path in said direction and at said second speed and back toward said predetermined portion of said first path upon entrainment of a blank by the commodity advancing along and beyond said predetermined portion of said first path.

16. The apparatus of claim 15, wherein said device is movable back toward and all the way to said predetermined portion by moving along said first path.

17. The apparatus of claim 15, wherein said device surrounds a part of said first path.

18. The apparatus of claim 11, wherein said second speed is less than said first speed during each stage of transport of a blank by said transporting means beyond said predetermined portion of and along said first path.

19. The apparatus of claim 11, wherein said transporting means comprises a mouthpiece defining a passage for the advancement of commodities therethrough and means for moving said mouthpiece in said predetermined direction from said predetermined portion of and along said first path through a predetermined distance which is sufficient to enable an oncoming commodity to catch up with the blank being transported by said mouthpiece, and thereupon counter to said direction along said first path and to a starting position at said predetermined portion of said first path.

20. The apparatus of claim 19, wherein said means for moving said mouthpiece comprises a carrier for the mouthpiece, at least one guide extending along said first path, and means for reciprocating said carrier along said at least one guide.

21. The apparatus of claim 11, wherein said transporting means comprises a mouthpiece movable along said first path in and counter to said direction from and back to a starting position in which a front portion of said mouthpiece is located behind a blank in said predetermined portion of said first path, said advancing means comprising a pusher reciprocable along said first path in and counter to said direction, and further comprising first motion transmitting means having means for reciprocating said mouthpiece so that the movements of said mouthpiece in said direction take place at said second speed, second motion transmitting means having means for reciprocating said pusher so that the movements of said pusher in said direction take place at said first speed, and a common driving unit for said first and second motion transmitting means.

22. The apparatus of claim 11, wherein said commodities have front sides and additional sides flanking the respective front sides, each of said blanks having a first panel abutting the front side of the respective commodity during entrainment of such blank along said first path, additional panels flanking the first panel, and fold lines between said first panel and the additional panels, said transporting means including means for prefolding the additional panels relative to the first panel along the respective fold lines during transport of a blank from said predetermined portion of said first path and prior to entrainment of the blank by the respective oncoming commodity.

23. The apparatus of claim 22, wherein said transporting means further comprises a mouthpiece reciprocable from a starting position at said predetermined portion of said first path in and counter to said direction, said mouthpiece having a front portion with folding edges abutting the fold lines of a blank in said predetermined portion of said first path while said mouthpiece assumes said starting position and during movement of the mouthpiece from said starting position in said predetermined direction, and means for effecting a relative movement between said prefolding means and said mouthpiece during transport of blanks along said first path and prior to entrainment of the blanks by the respective oncoming commodities to thus effect a pivoting of the additional panels along the respective fold lines and counter to said direction as a result of said movement of said prefolding means and the mouthpiece relative to each other.

24. The apparatus of claim 23, wherein said transporting means further comprises means for movably connecting said prefolding means with said mouthpiece.

25. The apparatus of claim 23, wherein said prefolding means comprises two prefolding members each adjacent a different one of said folding edges and each pivotable relative to said mouthpiece between a first position out of contact with an additional panel of the blank being transported by said folding edges and a second position in which the prefolding member maintains the additional panel in a pivoted position relative to the respective first panel.

26. The apparatus of claim 23, wherein said prefolding means comprises two prefolding members and means for pivotably coupling said prefolding members to said mouthpiece for movement of said prefolding members and the adjacent additional panels counter to said direction and at least partially beyond said folding edges of said mouthpiece as seen counter to said predetermined direction.

27. The apparatus of claim 26, wherein each of said prefolding members is dimensioned to lie flush against an entire additional panel of a blank having fold lines abutting said folding edges.

28. The apparatus of claim 26, wherein said prefolding members have windows.

29. The apparatus of claim 26, wherein the blanks have further panels and further fold lines between said additional and further panels, said prefolding members having further folding edges arranged to engage said further fold lines of a blank being transported by said mouthpiece along said first path, said transporting means comprising further folding members cooperating with said prefolding members to pivot the further panels relative to the respective additional panels during pivoting of said prefolding members relative to said mouthpiece.

30. The apparatus of claim 29, wherein said further folding edges are parallel to the folding edges of said mouthpiece.

31. The apparatus of claim 29, wherein said further folding panels have arcuate shapes and are adjacent to paths of pivotal movement of said prefolding members relative to said mouthpiece.

* * * * *